United States Patent [19]

Dekel

[11] 3,992,870

[45] Nov. 23, 1976

[54] WATERTIGHT NONCONDUCTIVE ELECTRONIC WATCHCASE INCLUDING CONDUCTIVE INTERNAL PLATE

[76] Inventor: Joseph Dekel, 4532 Jubilo Drive, Tarzana, Calif. 91356

[22] Filed: Aug. 14, 1975

[21] Appl. No.: 604,844

[52] U.S. Cl. ..... 58/23 BA; 58/33; 58/53; 58/55; 58/88 R

[51] Int. Cl.[2] ..... G04B 37/00; G04C 3/00; G04B 37/08

[58] Field of Search ..... 58/23 R, 23 BA, 33, 58/50 R, 53–55, 57, 59, 85.5, 88 R

[56] References Cited

UNITED STATES PATENTS

| | | | |
|---|---|---|---|
| 3,759,031 | 9/1973 | McCullough et al. | 58/50 R |
| 3,838,568 | 10/1974 | Zurcher et al. | 58/23 R X |
| 3,905,666 | 9/1975 | Grimm et al. | 58/23 R X |
| 3,911,663 | 10/1975 | Kern et al. | 58/23 BA |

*Primary Examiner*—Stanley J. Witkowski
*Attorney, Agent, or Firm*—McDougall, Hersh & Scott

[57] ABSTRACT

An electrically nonconductive watchcase for use with electronic timepieces is disclosed. By means of an internal plate electricity is conducted from the energy cells to the integrated circuit and display package without the need for utilizing the watchcase as a conductor. A clear latex boot provided over the integrated circuit and display package renders the unit substantially watertight.

10 Claims, 7 Drawing Figures

12
10
14
22
24
25
20
36
36
16
16
40
32
30
26
34
32
40
33
34
28

32
26
34
40
30
40
34
32

10
34
17
36
15
26

WATERTIGHT NONCONDUCTIVE ELECTRONIC WATCHCASE INCLUDING CONDUCTIVE INTERNAL PLATE

BACKGROUND OF THE INVENTION

This invention relates to the field of watchcases for the recently developed electronic and/or digital timepieces. Such timepieces employ an integrated circuit package powered by small energy cells which drive a visual display. In the case of digital watches, the display is usually of the seven segment type and may be light emitting diode, liquid crystal or similar type display.

Such a timepiece requires at least one external pushbutton switching arrangement whereby the time may be set or the display may be activated to indicate time, day, date, etc.

In presently available digital watches, it has been found necessary to utilize the watchcase housing as an electrical conductor to provide power from the energy cells to the pushbutton controllng the integrated circuit and display package. This dictated that the watchcase housing be formed of expensive conduction materials such as stainless steel, gold, silver, and the like. Accordngly, the cost of such digital timepieces has been inordinately high relative to conventional type wristwatches. Thus the improved accuracy and convenience of such digital timepieces are being denied to a large portion of the consuming public who cannot justify the higher expense of a digital timepiece.

Another problem with presently available digital watches is the necessity for maintaining the unit watertight since a very small amount of moisture can irreparably damage the integrated circuit display package.

It is accordingly an object of the present invention to provide a watertight digital watchcase which employs a clear latex boot to prevent the entry of moisture while permitting viewing of the display.

It is another object of the invention to provide a nonconductive watchcase which may be formed of inexpensive materials and which provides electrical current to the integrated circuit and display package by means of an internal conducting plate.

Other objects and advantages of the present invention will become apparent from the remaining portion of the specification.

DETAILED DESCRIPTION

As indicated in the background section, currently available digital wristwatches employ an integrated circuit (IC) and display package which is usually provided in a watchcase. Extending from the watchcase housing are one or more pushbuttons which either serve to override the normal counting code of the IC package to permit setting the device or serve to actuate the display. Power is applied to the IC package from the energy cell by using the metallic watchcase housing as a conductor. When the pushbuttons are activated, an electrical path is completed to specific inputs on the IC package.

Figure 1:
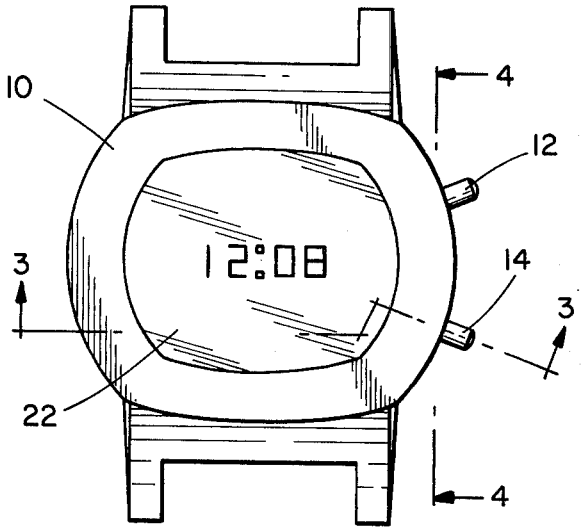
FIG. 1 is a top plan view of a digital timepiece having a watchcase according to the present invention.
Figure 2:
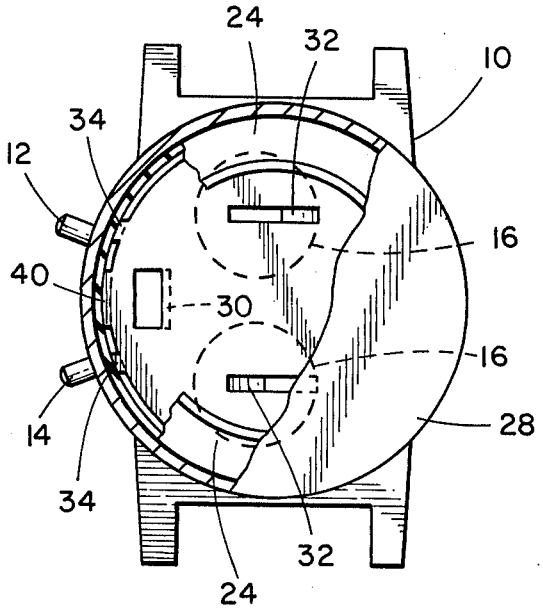
FIG. 2 is a bottom plan view similar to FIG. 1 having portions cut away to reveal the energy cell placement.

According to a preferred embodiment of the invention (FIGS. 1 and 2), a digital watchcase housing 10 is provided which is nonconductive and may be formed of any desirable material. In particular, the watchcase housing may be formed of low cost plastics or various inexpensive nonconductive metals. Extending through apertures in the housing 10 are pushbuttons 12 and 14 which, when activated, provide an electrical path from the energy cells 16 through a plate 26 to be described, to contacts provided on the IC package.

Figures 5, 6, 7:
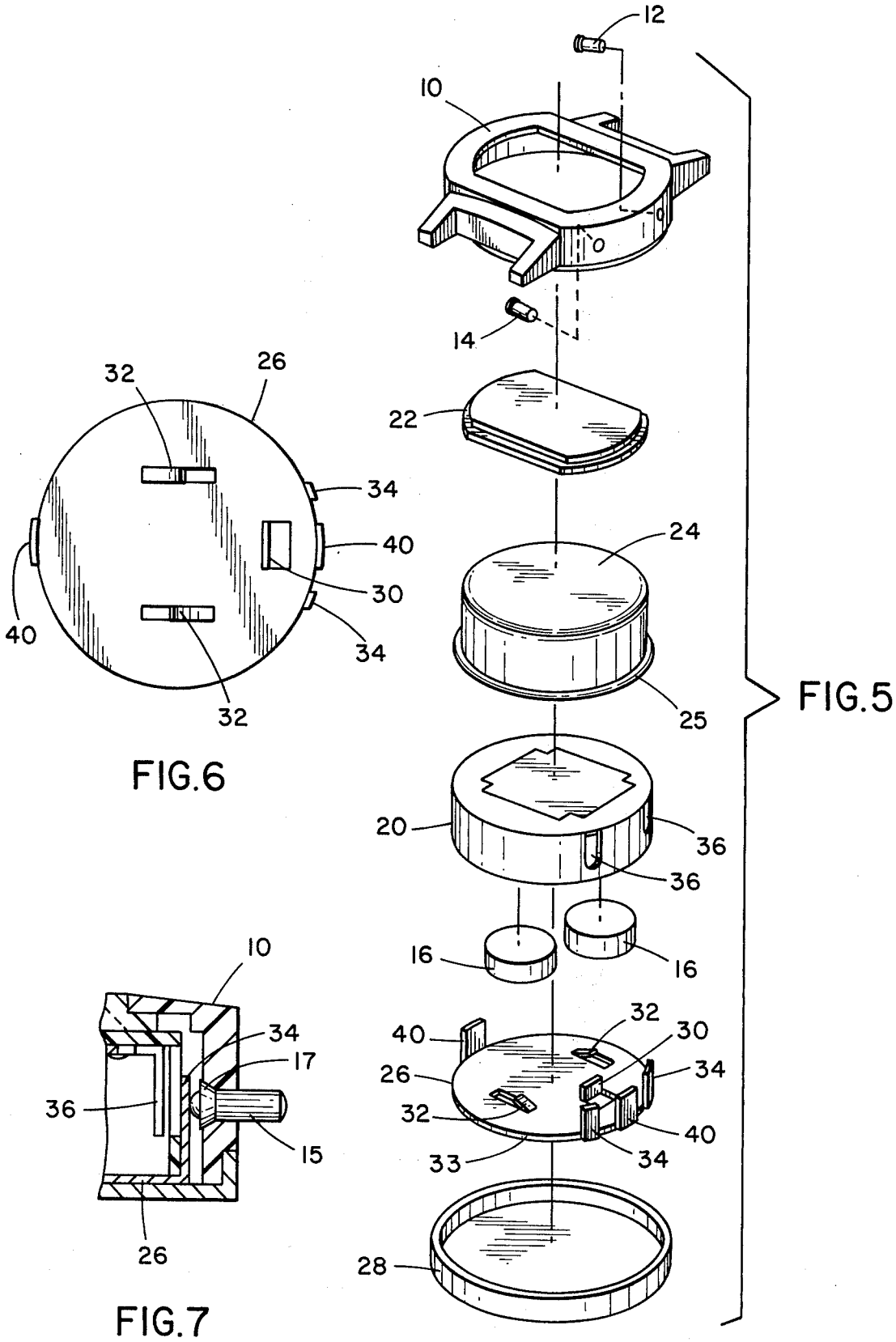
FIG. 5 is an exploded view illustrating the components of a digital watchcase according to the invention.
FIG. 6 is a bottom plan view of a switch spring according to the invention.
FIG. 7 is a cross-sectional view of a modification of the invention.

Referring to FIG. 5, the components of a digital watch, according to the present invention, are most clearly illustrated. The nonconductive housing 10 is provided with a pair of pushbuttons 12 and 14. A viewing crystal 22 fits in an appropriate opening in the housing 10. A clear latex boot 24 of appropriate size for a given IC package is placed thereover. The latex boot has an integral O-ring 25 formed on its bottom edge for a purpose to be described.

Energy cells 16 are receivable in recessed openings of the package 20 and a conductive plate 26 receivable in a bottom cap 28 is provided for conducting energy from the energy cells 16.

The conductive plate 26 has a locating tab 30 (FIG. 6) thereon and a pair of energy cell contacts 32 extending upwardly from its central disc portion 33. The energy cell contacts 32 press against the energy cell maintaining a good electrical path from the cell to the plate 26. Extending upwardly from the periphery of the disc portion 33 are one or two contacts 34 (FIG. 4). The number of contacts provided as well as their location, of course, depend upon the particular IC package utilized. Currently there are available one or two pushbutton packages and accordingly one or two contacts 34 will be necessary depending upon the package. Contacts 34 in the normal position (FIG. 3) reset close to the pushbuttons and out of electrical contact with the IC package contacts 36.

As will be readily appreciated by those skilled in the art, when it is desired to operate the time setting mechanism on the display the appropriate pushbutton(s) 12 and 14 are pressed, causing the plate contact(s) 34 to touch the contact areas 36 on the IC package 20. As thus far described, it will be appreciated that a nonconductive watchcase has been disclosed which utilizes an internal plate 26 to provide a conductive path from the energy cells 16 to the contacts 36 when a pushbutton is operated.

Figure 3:
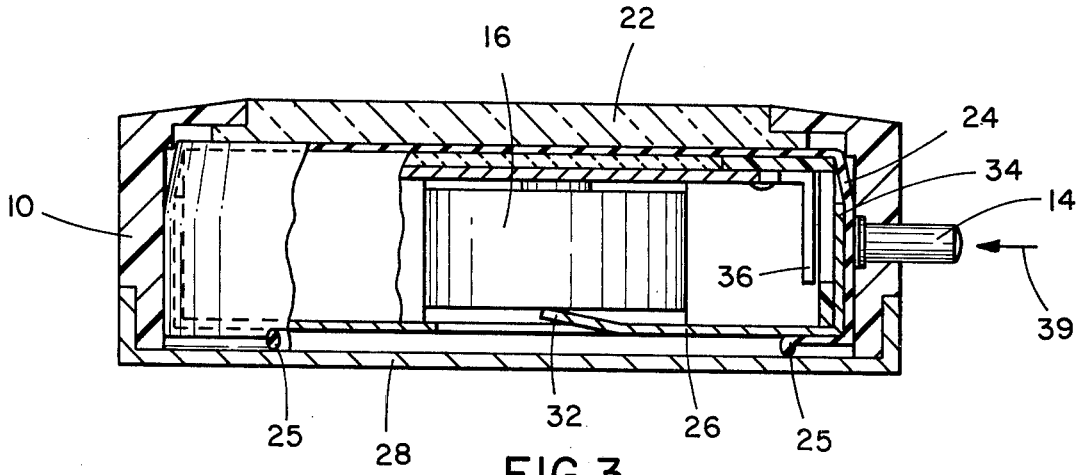
FIG. 3 is a sectional view along the lines 3—3 of FIG. 1, illustrating the manner in which the plate contacts the energy cells and cooperates with the pushbutton through the latex boot.
Figure 4:
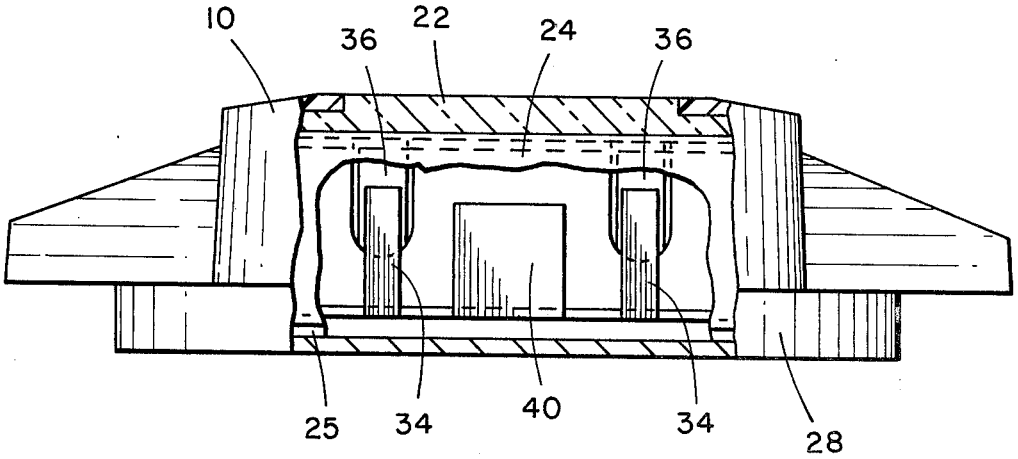
FIG. 4 is a sectional view along the lines 4—4 of FIG. 1 illustrating in greater detail the manner in which the switch spring contacts the integrated circuit package to supply energy thereto.

As may be seen from an examination of FIG. 3, the plate 26 is disposed inside the latex boot 24, which boot extends downwardly and inwardly of the plate and terminates in the O-ring configuration 25. The O-ring is compressed between the plate and the bottom cap 28 to provide a moisture-tight cell over substantially the entire surface of the IC package and when the bottom cap is in position, the O-ring completely seals the package against the entrance of moisture. As indicated in FIG. 3, the pushbutton 14, when depressed in the direction indicated by the arrow 39, pushes the contact 34 through the latex boot 24 against the contact 36 of the IC package.

Referring again to FIG. 5, it will be seen that there are tabs 40 on either side of the plate to securely retain the IC package against the plate disc 33 to maintain good electrical contact between the contacts 34 and the energy cells 16.

Accordingly, there has been disclosed herein an improved watchcase which is both watertight and has electrically nonconductive housing. Significant economics in manufacture can be obtained since the housing can be formed of inexpensive materials. The plate is preferbly formed of stainless steel, but other conductive metals can of course be utilized. The specific configuration of the plate will change with the particular IC package utilized, the location of the energy cells and the number and location of IC contacts. Regardless of configuration, however, the use of the plate disclosed herein results in a significant cost savings per unit over watchcases which must be electrically conductive.

Referring now to FIG. 7, a modification of the present invention is illustrated. In this modification, the watchcase is made substantially watertight without the need for the latex boot 24. A primary function of the latex boot in waterproofing the watchcase is to prevent entry of moisture through the pushbutton apertures. In FIG. 7 there is illustrated an arrangement whereby a pushbutton 15 is placed in the watchcase 10 by forcing it into the aperture pushing against the watchcase. By so doing, a watertight seal is created in the watchcase housing. The pushbutton 15 in this embodiment has a valve-like conical head 17 which seats against the housing to form the watertight seal.

When the pushbutton is not actuated, the conical head 17 is maintained against the housing by action of the plate 26 pressing thereagainst. It will thus be apparent that in this modification the plate 26 serves a dual purpose: first, to keep the pushbutton pressed against the housing for watertight sealing purposes, and second, to conduct electrical energy from the energy cells to the IC package when the button is manually actuated.

While I have shown and described embodiments of this invention in some detail, it will be understood that this description and accompanying illustrations are offered merely by way of example, and that the invention is to be limited in scope only by the appended claims.

I claim:

1. A watchcase for an electronic timing device powered by included electrical energy cells, said device having contact areas for completing an electrical path from said energy cells to said contact areas on manual activation of an associated pushbutton to present a visual display comprising:

a housing formed of an electrically insulating material receiving said timing device therein, said housing having at least one opening therethrough for mounting said manually actuated pushbutton;

an electrically conductive plate dimensioned to fit within said housing and engaging said device to electrically contact said energy cells;

said plate having at least one resilient contact extending therefrom to a position between said pushbutton and said contact area and out of contact with the latter;

whereby said resilient contact completes an electrical path from said energy cell to said contact area only during actuation of said pusbutton.

2. The device according to claim 1 further including a bottom cap engaging said housing to enclose said timing device and a transparent crystal positioned in an opening of said housing provided therefor, whereby said timing device can be viewed through said crystal.

3. The device of claim 1 further including a clear latex boot disposed over said timing device and said switch spring to substantially seal said device and switch spring against the entry of moisture.

4. The device of claim 3 wherein said latex boot is open at the bottom end thereof having an integral O-ring formed along its terminating end, said watchcase further includes a bottom cap engaging said housing and compressing said O-ring against said switch spring to substantially completely seal said timing device and switch spring against the entry of moisture.

5. The device according to claim 1 wherein said housing is formed of plastic material.

6. The device according to claim 1 wherein said switch spring includes a disc shaped body having engaging tabs provided thereon for maintaining said switch spring in contact with said timing device.

7. The device according to claim 6 wherein said resilient contacts extend upwardly from the periphery of said disc to said position between said pushbutton and said contact area and wherein said disc-shaped portion has centrally located energy cell contacts formed thereon which are resiliently pressed against said energy cells.

8. The device according to claim 7 further including a clear latex boot disposed over said timing device and said switch spring to maintain said timing device substantially watertight while permitting viewing of its display, said pushbutton actuating said switch spring contact through said latex boot.

9. The device according to claim 1 wherein said switch spring is formed of stainless steel.

10. The device according to claim 1 wherein said pushbutton has a conical head for maintaining a watertight engagement with said housing, said switch spring normally biasing said pushbutton against said housing except when manually actuated.

* * * * *